US005663674A

United States Patent [19]

Beyer et al.

[11] Patent Number: 5,663,674

[45] Date of Patent: Sep. 2, 1997

[54] CIRCUT CONFIGURATION FOR GENERATING A REFERENCE CURRENT

[75] Inventors: Stefan Beyer, Mering; Bruno Scheckel, Ebersberg; Werner Veit, Unterhaching; Jean Wilwert, München, all of Germany

[73] Assignee: Siemens Aktiengesellschaft, Munich, Germany

[21] Appl. No.: 551,267

[22] Filed: May 11, 1995

[30] Foreign Application Priority Data

May 11, 1994 [DE] Germany ..... 44 16 711.3

[51] Int. Cl.[6] ..... G05F 3/02

[52] U.S. Cl. ..... 327/540; 327/538; 327/539; 327/545; 323/315

[58] Field of Search ..... 327/538, 539, 327/540, 541, 543, 545, 546; 323/313, 315

[56] References Cited

U.S. PATENT DOCUMENTS

| | | | |
|---|---|---|---|
| 4,008,441 | 2/1977 | Schade, Jr. | 323/315 |
| 4,280,090 | 7/1981 | Lindberg | 323/315 |
| 4,437,023 | 3/1984 | Gill, Jr. . | |
| 4,525,683 | 6/1985 | Jason . | |
| 4,550,262 | 10/1985 | Kohsiek . | |
| 4,591,739 | 5/1986 | Nagano | 323/315 |
| 4,608,530 | 8/1986 | Bacrania | 323/315 |
| 4,792,748 | 12/1988 | Thomas et al. | 323/315 |
| 4,943,737 | 7/1990 | Guo et al. | 323/315 |
| 4,990,864 | 2/1991 | Kwan | 323/315 |
| 5,027,014 | 6/1991 | Bass et al. | 323/315 |
| 5,180,966 | 1/1993 | Sugawara et al. | 323/315 |
| 5,254,883 | 10/1993 | Horowitz et al. | 327/541 |
| 5,432,433 | 7/1995 | Ikeda | 323/315 |

FOREIGN PATENT DOCUMENTS

| | | |
|---|---|---|
| 0 525 421 | 2/1993 | European Pat. Off. . |
| 0 536 063 A1 | 4/1993 | European Pat. Off. . |
| 0 536 063 B1 | 7/1995 | European Pat. Off. . |

OTHER PUBLICATIONS

IEEE Journal of Solid-State Circuits Publ., vol. SC-14, No. 3, Jun. 1979, (Tzanateas et al.), pp. 655–657, "A CMOS Bandgap Voltage Reference".

Patent Abstract of Japan (Masaharu), Feb. 12, 1986.

EDN-Electrical Design News Publ. 33 (1988) Oct. 27, No.22, (Gross), pp. 297–308, "Use npn and pnp devices effectively in semicustom arrays".

*Primary Examiner*—Terry Cunningham

*Attorney, Agent, or Firm*—Herbert L. Lerner; Laurence A. Greenberg

[57] ABSTRACT

An integrated circuit configuration for generating a reference current by bipolar technology includes a transistor of one conduction type having a control terminal being acted upon by a reference voltage and having a load path. An externally connectable resistor is to be connected between the load path of the transistor and a reference potential. A current mirror configuration has an input side connected between the load path of the transistor and a supply voltage source and has an output for picking up a reference current.

3 Claims, 1 Drawing Sheet

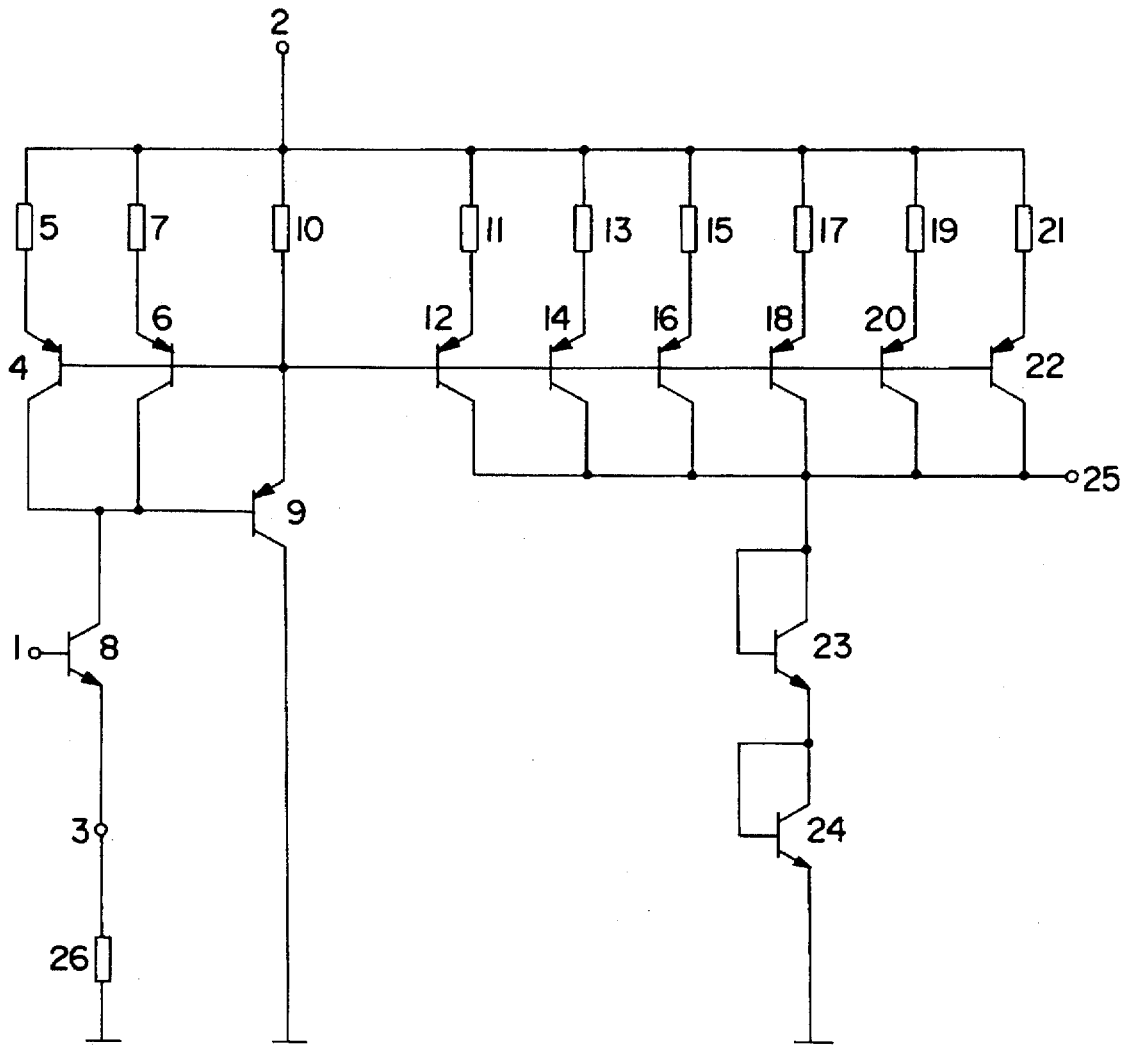
2
5
7
10
11
13
15
17
19
21
6
12
14
16
18
20
4
22
25
9
1
8
23
3
24
26

CIRCUT CONFIGURATION FOR GENERATING A REFERENCE CURRENT

BACKGROUND OF THE INVENTION

FIELD OF THE INVENTION

The invention relates to a circuit configuration for generating a reference current.

In order to provide a precisely defined rise time in a given external wiring, a phase-locked loop (PLL) component, for instance, requires an exact reference current that is independent of temperature. If a CMOS-type PLL is used, then generating that reference current at the PLL component involves overly high tolerances, since the corresponding CMOS process is not especially "analog-capable".

A reference current generated by CMOS technology would thus involve tolerances and be unsuitable for a downstream PLL circuit, for instance.

SUMMARY OF THE INVENTION

It is accordingly an object of the invention to provide a circuit configuration for generating a constant adjustable reference current for a CMOS circuit configuration, which overcomes the hereinafore-mentioned disadvantages of the heretofore-known devices of this general type.

With the foregoing and other objects in view there is provided, in accordance with the invention, an integrated circuit configuration for generating a reference current by bipolar technology, comprising a transistor of one conduction type having a control terminal being acted upon by a reference voltage and having a load path; an externally connectable resistor to be connected between the load path of the transistor and a reference potential; and a current mirror configuration having an input side connected between the load path of the transistor and a supply voltage source and having an output for picking up a reference current.

In accordance with another feature of the invention, the transistor of the one conduction type is a first transistor; and the current mirror includes n transistors of the other conduction type having load paths being connected to the load path of the first transistor and having control terminals; a second transistor of the other conduction type having a control terminal connected to the load paths of the n transistors and having a load path; first resistors each being connected between the load path of a respective one of the n transistors and the supply voltage terminal; m transistors of the other conduction type having load paths being connected to one another and to the output terminal and having control terminals; second resistors each being connected between the load path of a respective one of the m transistors and the supply voltage terminal; and a third resistor; the control terminals of the n and m transistors being connected to one another, being connected through the third resistor to the supply voltage terminal and being connected through the load path of the second transistor to the reference potential.

In accordance with a further feature of the invention, there are provided two diodes being connected in the flow direction between the output terminal and the reference potential.

In accordance with a concomitant feature of the invention, the reference voltage is generated by a band gap filter.

In order to attain the object referred to above, according to the invention the reference current for a CMOS circuit configuration is generated on a bipolar component, on which, for instance, an oscillator to be regulated is also located.

Other features which are considered as characteristic for the invention are set forth in the appended claims.

Although the invention is illustrated and described herein as embodied in a circuit configuration for generating a reference current, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The figure of the drawing is a schematic circuit diagram of an exemplary embodiment of the invention.

DESCRIPTION OF THE PREFERRED EMBODIMENTS

Referring now to the figures of the drawing in detail and first, particularly, to FIG. 1 thereof, it is seen that reference numeral 1 indicates an input terminal to which a reference voltage can be delivered. The input terminal 1 is connected to a base terminal of a first npn transistor 8. An emitter of the npn transistor 8 is connected to ground through an external connection terminal 3 and an externally connectable resistor 26. A collector of the transistor 8 is connected on one hand to a base of a second pnp transistor 9 and on the other hand to collectors of two pnp transistors 4 and 6. A collector of the transistor 9 is connected to ground. Emitters of the transistors 4 and 6 are connected, through respective first resistors 5 and 7, to a supply voltage terminal 2. The supply voltage terminal 2 is also connected through a third resistor 10 to an emitter of the transistor 9.

In the exemplary embodiment, six pnp output transistors 12, 14, 16, 18, 20, 22 which are also provided have base terminals that are each connected to one another, to base terminals of the transistors 4 and 6 as well as to the emitter of the transistor 9. The supply voltage terminal 2 is connected through respective second resistors 11, 13, 15, 17, 19, 21 to emitters of the transistors 12, 14, 16, 18, 20, 22. Collectors of the transistors 12, 14, 16, 18, 20, 22 are connected to one another and to an output terminal 25.

Finally, the output terminal 25 is connected to ground through two transistors 23, 24 that are connected in series as a diode.

A reference voltage which is derived from a high-precision constant current that is generated, for instance, in a band gap filter, is supplied to the base of the transistor 8. The desired reference current is established with the aid of the external resistor 26. In the example shown, this current is reflected by a factor of three by a current mirror which includes the transistors 4, 6, 9, 12, 14, 16, 18, 20, 22 and the resistors 5, 7, 10, 11, 13, 15, 17, 19, 21, and is available at the output terminal 25 for a following CMOS circuit configuration.

Due to the circuit configuration, this reference current is independent of the supply voltage. The tolerance of the external resistor 26 determines the corresponding deviation of the reference current. The temperature dependency of the current is minimal, since the corresponding bias circuit in bipolar technology is very well temperature-compensated.

The transistors 23 and 24 that are connected as a diode enable an outflow of the reference current to ground when the output terminal 25 is not connected, or when a following CMOS circuit is in a so-called standby mode.

The number of parallel-connected transistors in the input circuit of the current mirror, which are the transistors 4 and 6 in the illustrated example, and the number of transistors in the output circuit, which are the six transistors 12, 14, 16, 18, 20, 22 in the illustrated example, can be selected arbitrarily and is determined by the magnitude of the desired output current.

We claim:

1. An integrated circuit configuration for generating a reference current by bipolar technology, comprising:

an input terminal receiving a reference voltage and an external connection terminal;

a first transistor of one conductivity type having a control terminal being connected to said input terminal, an emitter connected to said external connection terminal, and a load path;

an external resistor being connected between said load path of said transistor via said external connection terminal and a reference potential;

a current mirror configuration having an input side connected between said load path of said transistor and a supply voltage source and having an output for picking up a reference current; and said current mirror including:

n transistors of an other conductivity type having load paths being connected to said load path of said first transistor and having control terminals;

a second transistor of the other conductivity type having a control terminal connected to said load paths of said n transistors and having a load path;

first resistors each being connected between said load path of a respective one of said n transistors and the supply voltage terminal;

m transistors of the other conductivity type having load paths being connected to one another and to said output terminal and having control terminals;

second resistors each being connected between said load path of a respective one of said m transistors and the supply voltage terminal;

a third resistor; and said control terminals of said n and m transistors being connected to one another, being connected through said third resistor to the supply voltage terminal and being connected through said load path of said second transistor to the reference potential.

2. The circuit configuration according to claim 1, including two diodes being connected in the flow direction between said output terminal and the reference potential.

3. The circuit configuration according to claim 1, wherein the reference voltage is generated by a band gap filter.

* * * * *